United States Patent [19]

Watson

[11] Patent Number: 4,921,240

[45] Date of Patent: May 1, 1990

[54] PLURAL BELT DOCUMENT FEEDER

[75] Inventor: Peter R. Watson, Stevenage, United Kingdom

[73] Assignee: Xerox Corporation, Stamford, Conn.

[21] Appl. No.: 297,221

[22] Filed: Jan. 13, 1989

[30] Foreign Application Priority Data

Jan. 13, 1988 [GB] United Kingdom ..... 8800720

[51] Int. Cl.[5] ..... B65H 9/06

[52] U.S. Cl. ..... 271/245; 271/197; 271/276; 355/76

[58] Field of Search ..... 271/194, 196, 197, 245, 271/276, 94, 95, 96; 355/76; 198/689.1, 841

[56] References Cited

U.S. PATENT DOCUMENTS

| | | | |
|---|---|---|---|
| 3,819,175 | 6/1974 | Borostyan | 271/174 |
| 3,826,568 | 7/1974 | Hudson | 355/3 |
| 3,889,801 | 6/1975 | Boyer | 198/184 |
| 4,421,306 | 12/1983 | Muka | 271/5 |
| 4,618,138 | 10/1986 | Silverberg | 271/245 |
| 4,660,752 | 4/1987 | Rikard et al. | 226/95 |
| 4,669,870 | 6/1987 | Fosh | 355/76 X |
| 4,831,419 | 5/1989 | Iaia, Jr. et al. | 271/197 X |

FOREIGN PATENT DOCUMENTS

| | | | |
|---|---|---|---|
| 317675 | 9/1974 | European Pat. Off. . | |
| 0136713 | 10/1981 | Japan | 271/276 |
| 2028247 | 3/1980 | United Kingdom | 198/689.1 |

OTHER PUBLICATIONS

McCarty, "Sheet Material Transport System", 5-1974, IBM Technical Disclosure Bulletin, vol. 16, No. 12.

*Primary Examiner*—H. Grant Skaggs
*Assistant Examiner*—Boris Milef

[57] ABSTRACT

An automatic or semi-automatic document feeder (12) for conveying documents sheets (17) into and away from an imaging position (18) on a platen (14) of a copier, incorporating a plurality of spaced-apart belts (30) moving between a white backing surface (26) and the platen. A vacuum source applies a partial vacuum to the inter-belt gaps (32) to hold a document sheet against the belts so that the document is conveyed with the movement of the belts. A major portion of the backing surface (26) lies in a datum plane. Discrete protrusions(56) which extend above the datum plane are formed integrally on the backing surface in pairs or rows, against which the belts ride to hold the belts in spaced relation to the datum plane. The spaces (57) between the protrusions provide openings so that a partial vacuum applied beneath the belts may extend into the inter-belt gaps. "Show-through" and "show-around" printing defects are thus substantially reduced because the backing surface can be entirely flat between the belts and the belts themselves require no apertures. Channels may be provided beneath the belts in the longitudinal direction thereof to ensure the application of uniform partial vacuum over the whole platen area.

4 Claims, 2 Drawing Sheets

PLURAL BELT DOCUMENT FEEDER

Figure 1:
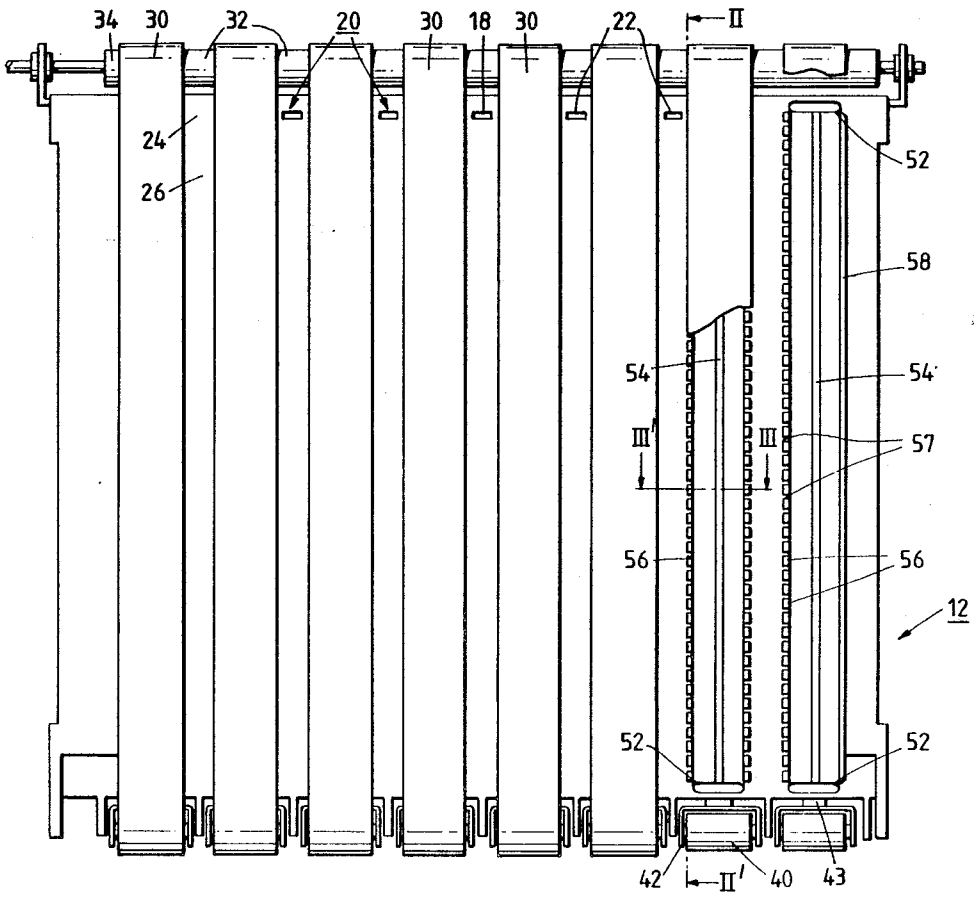

This invention relates to a document feeder for conveying document sheets into and away from an imaging position on a platen of a copier.

The art of original document sheet feeding for copiers has been intensively pursued in recent years, particularly with a view towards achieving lower cost, more compact, and lighter weight document handlers.

Document feeders may be automatic or semi-automatic. In the former, document sheets are removed automatically by the feeder from a stack one-by-one and are conveyed in turn to a registered imaging position on the platen of the copier for copying. The document sheet is then removed from the platen and re-stacked elsewhere. In a so-called recirculating document feeder the sheets are returned to the top of the original stack. In semi-automatic feeding the operator is required to present the original documents one at a time to the feeder, but the document feeder itself then conveys the document individually to the imaging position and subsequently expels them onto a restacking tray.

A known type of document feeder employs a vacuum belt transport system comprising a plurality of spaced-apart belts moving between a white backing member and the platen. The belts are provided with an array of holes along their length and a partial vacuum is applied from behind the belts through these holes to hold the document sheet against the belts so that the document is conveyed with the movement of the belts. The belts conventionally have a relatively high coefficient of friction to aid document transport.

However, vacuum belt transport systems of the kind described above tend to give rise to copy defects known as "show-through" and "show-around". Show-through is the phenomenon of dark areas printed on the copy when the optics sees through the document being copied which is particularly a problem with transparent, or very thin, or otherwise translucent documents. Show-around occurs when the document being copied is not exactly coincident with the imaged area which results in exposure of areas of the belt transport system outside the area of the document being copied. This may occur, for example, if the document is mis-registered, or when a reduction copy is being made and the size of the original document is not exactly compatible with the selected reduction ratio. Both show-through and show-around area consequence of a shadowing effect at the edges of the belts and the apertures, and since the belts ride in contact with the backing member there is also a tendency for contamination and debris to build up and even damage the surface of the backing member at the belt edge which further contributes to the print defect problem.

EP-A-0 220 036 and EP-A-0 220 037 (corresponding to U.S. Ser. Nos. 788 299 and 788 376) propose a plural belt vacuum document feeder which dispenses with apertures in the belts altogether. In this case, the partial vacuum is applied from a vacuum source via an array of inter-communicating channels in the backing surface extending both parallel and transverse to the direction of movement of the belts. Thus the partial vacuum extends into the inter-belt gaps and is applied to a document at the area of the inter-belt gaps so that the document is held against the belts and is conveyed with the movement of the belts.

This arrangement has the advantage that it avoids show-through and show-around associated with apertures in the belts, but the problem of show-through and show-around is not completely eliminated because of the presence of the cross-channels between the belts. When thin originals are copied, the surface details of the backing member in the inter-belt regions may show-through and appear as defects on the copy. Furthermore, there remains a problem caused by shadow effects where the belts overhang the transverse grooves and contamination and debris still tend to collect on and grind into the backing surface at the edges of the belts where the belts bear directly against the backing surface.

According to the present invention there is provided a document feeder for conveying document sheets into and away from an imaging position on a platen of a copier, including a vacuum belt transport system which comprises a plurality of spaced-apart belts moving between a white backing surface and the platen, a major portion of the backing surface lying in a datum plane, and a vacuum source for applying a partial vacuum to the inter-belt gaps to hold the document sheet against said belts so that the document is conveyed with the movement of the belts, characterised in that protrusions which extend out from the datum plane towards the platen are provided at intervals on the backing member beneath the belts, against which protrusions the belts ride to hold the belts in spaced relation to the datum plane, the interstices between the protrusions providing openings to the inter-belt gaps from beneath the belts.

A document feeder in accordance with the invention has the advantage that the show-through and show-around problem associated with known plural belt vacuum document transport systems can be substantially reduced. In particular, the interstices between the protrusions provide openings to the inter-belt gaps from beneath the belts so that the space below the belts is pneumatically connected to the inter-belt gaps, but without the need for cross-channels. In this way a partial vacuum applied beneath one or more of the belts will extend into each of the inter-belt gaps and so will be effective to hold a document sheet against the belts. Since this arrangement dispenses altogether with the requirement for transverse channels in the inter-belt gaps, the backing member may be substantially entirely flat in the inter-belt gaps, at least in the imaging area, thus completely eliminating the print defect problems associated with these cross-channels in the prior art vacuum belt transport system discussed above.

Furthermore, in the present document feeder the belts are spaced above the major portion of the backing surface by the protrusions so that contamination and debris does not tend to collect at the belt edges and since the belts are not in rubbing contact with the major portion of the backing surface any contaminants or debris which are present are less likely to damage the backing surface, and this contributes to reduced show-through and show-around.

In a particular embodiment the protrusions are provided in mutually parallel rows extending in the direction of movement of the belts, with each belt riding on a respective pair of such rows of protrusions. Preferably, the rows of protrusions are disposed closely adjacent the edges of the belts to provide optimum support for the belts.

In a preferred embodiment channels are provided in the backing member extending parallel to the belts, wherein each belt overlies a respective channel. These channels facilitate air flow beneath the belts and so help to establish a uniform vacuum level along the full length of the channels.

The partial vacuum may be applied from the vacuum source through one or more apertures in the backing member. If the belts are transparent or translucent the aperture(s) is/are preferably located outside the area of the imaging position so they cannot be exposed which is advantageous for reducing show-through and show-around.

Also, it is noted here that the belts themselves are preferably unapertured over their entire length in order to contribute to reduced show-through and show-around, as discussed. However, the present invention may also have application in a vacuum belt transport system where the belts do have apertures.

Figure 2:
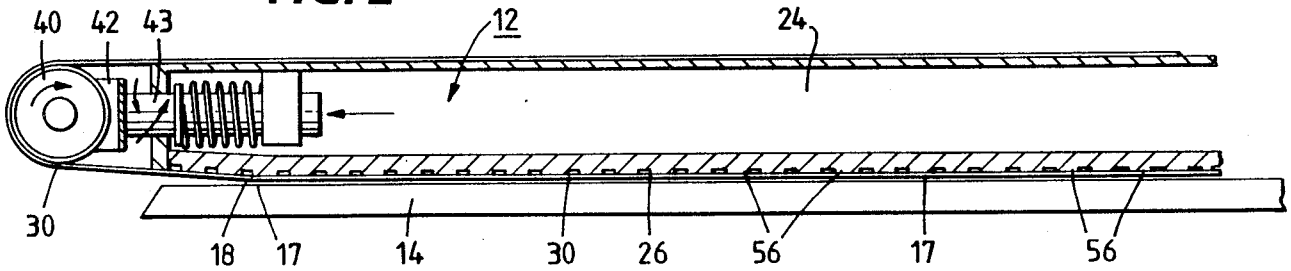
Figure 3:
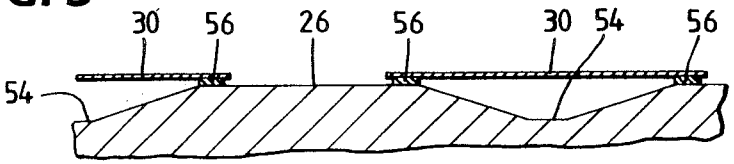

An embodiment of the invention will now be described, by way of example, with reference to the accompanying drawings, in which FIG. 1 is a partially cut-away plan view from below of a vacuum belt transport system for a document feeder in accordance with the invention, FIG. 2 is a cross section on the line II—II' of FIG. 1 and FIG. 3 is an enlarged cross section on the line III—III' in FIG. 1 exaggerated in depth dimension.

With reference to FIGS. 1 and 2 there is shown a vacuum belt transport system 12 of a document feeder for sequentially transporting document sheets over the imaging station of a platen 14 of a copier. The platen transport system 12 is adapted to register each document sheet 17 at a registration position 18 on the platen 14. Registration is provided by a registration system 20, including plural registration fingers 22 for engaging, stopping and deskewing, without damage, the lead edge of each document sheet 17, as described in detail in the aforementioned European Patent Applications.

The vacuum belt transport system 12 includes a vacuum plenum or manifold 24 having a white backing or imaging surface 26 closely overlying the platen 14. The plenum backing surface 26 is in turn closely overlaid with eight moving transport belts 30 approximately 28 mm wide. The belts 30 are spaced-apart by gaps approximately 13 mm wide. The belts 30 are held spaced-apart from the major portion of the backing surface 26 by protrusions 56 provided at intervals on the backing surface, as discussed in more detail below. The belts 30 are each narrow, endless loops of white, substantially opaque, low frictional, nonelastomeric, plastic belts. They are preferably much less than 0.5 mm thick and a thickness of only approximately 0.2 mm has been found to be operative and desirable. The preferred belts 30 have a coefficient of friction of approximately 0.2 against paper.

The belts 30, the gaps 32 therebetween, and the underlying surface 26 of the vacuum plenum preferably extend over the whole area of the platen 14 and the area of the platen 14 is sufficiently large that most standard size documents will occupy only a portion of the entire platen area. This provides not only for the transporting of a wide variety of document sizes, but also for a wide range of reduction imaging of documents, wherein large areas of the platen outside the document area may also be copied.

It is noted that in this embodiment none of the belts 30 are apertured. Unlike a conventional vacuum belt transport system for documents, no vacuum is supplied or applied through any of the belts. By contrast, vacuum is applied to the document in the transport system 12 from the gaps 32 between the belts as discussed in more detail below. It holds the document sheet against the belts 30 with sufficient force that the low friction engagement of the movement of the moving belts 30 against such vacuum-retained documents provides an adequate transporting force, that is, sufficient normal force between the paper sheet and the belts such that even with the low coefficient of friction of the belts there is sufficient forward transporting force to reliably transport the document with minimal slippage from the initial engagement of the documents upstream of the platen, then across the platen to the downstream edge thereof, i.e. toward and into the registration position 18, and then to eject the document from the platen after it has been registered and copied. The applied vacuum also helps to retain or lift up the belts 30 and the document sheet thereon out of substantial engagement with the platen 14, thereby reducing frictional resistance to feeding and static electricity generation between the document or belts and the platen. (Conventional brush or pin coronode or other electrostatic discharge means may be provided for the documents, the belts and/or the platen, if desired).

The platen transport system 12 may have thin pads or spacing feet outside the imaging area, for maintaining the plenum imaging surface 26, and therefore also the belts 30 riding under it, slightly spaced from the upper surface of the platen 14 as described in more detail in the above-cited European Patent Applications. This ensures all portions of the document, even if curled or wrinkled, are held to within the optical depth of field tolerances of the copier.

Preferably the entire transport system 12 is based on a single monolithic white plastic moulding which forms the entire vacuum plenum 24, including the surface 26 and protrusions 56, and also has formed at the ends thereof the mounting members for the rollers driving and supporting the belts, and for other components as described below.

As shown in FIGS. 1 and 2, the opposite ends of each belt loop are mounted on rollers at opposite ends of the platen transport system 12, outside the platen area. All of the belts are commonly held in the same relative position at one end thereof on the common driven roller 34. However, it may be seen that the opposite end of each belt is independently supported on individual pivotal rollers 40, as shown in FIG. 2. Each of these rollers 40 is freely rotatably about its own cylindrical axis. Each roller 40 is rotatably mounted between the extending arms of a yoke 42. Each yoke 42 has a central mounting shaft 43, spring loading it outwardly to independently tension each belt 30 by the outward force applied to the roller 40. This mounting shaft 43 is itself rotatable about its own axis, which is an axis perpendicular to the axis of rotation of the rollers 40. This allows each roller 40, and therefore the belt thereon, to tilt slightly in either direction relative to the plane of the surface 26 and therefore relative to the normal plane of the belt 30. This provides a desirable self-tracking or alignment of each belt 30. In addition, the extending arms of the yoke 42 between which the roller is mounted provide edge flanges which limits lateral travel of the belt and prevent the belt escaping from either end of roller 40.

Turning now to the vacuum system for the platen transport system 12, the vacuum source may be provided by a conventional but very low pressure fan, blower, or pump (not shown) as described, for example in the aforementioned European Patent Applications. Preferably the vacuum source is pneumatically connected to one side (the rear end) of vacuum plenum 24. A very low level of partial vacuum may be applied, for example in the order of 8 mm of water or less. To operatively communicate this vacuum for document transporting, it must be provided between the document and the backing surface 26. With the present system, this is accomplished without any vacuum apertures whatsoever in the manifold surface 26 anywhere overlying the platen 14. The only apertures at all in the imaging surface 26 are vacuum apertures 52 located along the opposite (input and output) edges of the transport system 12 outside the area of the surface 26 covering the platen 14. These vacuum apertures are located at opposite ends of respective elongate vacuum channels 54 in the plenum backing surface 26. The channels 54 have a flat-bottomed V-shape and extend directly below the lower flights of the belts 30 as can be seen most clearly in FIG. 3. The edges of the belts ride on protrusions 56 at opposite edges of the vacuum channels 54, as mentioned previously. It is noted here that this configuration of vacuum apertures 52 and cross-section for the channels 54 permits the belts to be transparent or translucent rather than opaque and still minimize show-through and show-around.

The channels 54 are suitably approximately 3 mm deep and 21 mm wide at the widest point tapering to approximately 3 mm at the bottom. The side walls of the channels are sloped, for example by 32°, with respect to the horizontal (angle of depression). The channels 54 (except for the outermost channels—as discussed below) are flanked on each side by a respective row of bumps or protrusions 56 formed integrally with the backing surface 26. These bumps or protrusions suitably have a substantially rectangular cross-section in the plane parallel to the backing surface 26 and protrude approximately 0.5 mm above the general level of the backing surface 26. Laterally, the bumps or protrusions 56 may be 4 mm long in the direction parallel to the movement of the belts and 2.5 mm in the transverse direction. Adjacent bumps may be spaced apart by 2 mm, yielding a pitch of 6 mm. Suitably, there may be seventy such bumps in each row although, for the sake of clarity fewer bumps are shown in FIG. 1. The belts 30 ride over the pairs of rows of bumps 56 associated with each channel 54 with the edges of the belts substantially aligned with the external edges of the bumps 56, although the belts alternatively may slightly overhang the bumps, for example by 1.5 mm. Although the channels 54 are relatively shallow, they have sufficient cross sectional area to conduct the requisite air flow with relatively low resistance, and thereby to apply the same vacuum level substantially uniformly along the entire channel length. The interstices 57 between the bumps 56 provide relatively wide openings (2 mm) from beneath the belts 30 to the inter-belt gaps 32 so that the partial vacuum obtaining in the channels 54 may extend into the inter-belt gaps 32 over the full length of the channels 54, that is to say, over substantially the whole platen area.

As far as the two outermost channels 54 are concerned, rows of discrete bumps 56 are provided on the internal edge only, whereas a respective continuous ridge 58, the same height, i.e. 0.5 mm, as the bumps 56, is provided the full length of the channels 54 so that the outer edges of the out most belts 30 pneumatically seal against these ridges 58 to maintain a uniform reduced pressure even towards the edges of the transport system.

It is emphasized that the backing surface 26 is substantially entirely flat in the region between the belts, that is to say in the inter-belt gaps. The avoidance of channels in the inter-belt gaps contributes significantly to reduced show-through and show-around as discussed in detail previously.

It can now be seen that the major, planar portion of the backing surface 26 lies in or defines a datum plane and that the protrusions 56 extend out of this datum plane towards the platen 14 to hold the belts in spaced relation to the datum plane. It will be evident therefore that it is not essential to employ channels in the backing surface beneath the belts since—depending on the height of the bumps and the required vacuum level—the space below the belts may provide an adequate conduit if the backing surface is completely flat everywhere except for the raised bumps 56.

The document feeder disclosed herein may be utilized in either a semi-automatic, fully-automatic, and/or a recirculating document feeder, as discussed above, in conjunction with any appropriate copier. This document feeder may be constructed and operated at relatively low cost. It is relatively light in weight, and therefore easily pivotably mounted over a copier platen for lifting away from the platen for alternative manual document registration and copying. It provides reliable and accurate registration with protection from document damage. It also minimises show-through and show-around copy defects.

In view of the foregoing description, it will be evident to a person skilled in the art that various modifications may be made within the scope of this invention. For example the dimensions of the protrusions, their spacing, and their profile may be varied from the particular examples quoted above. More specifically, for example, the internal face of the bumps adjacent the channel edge (i.e. the opposing faces of a pair of rows of bumps associated with a particular channel) may slope in the same direction as the internal wall of the channel and the sloping face may even extend into the channel. This profile is both pneumatically and mechanically advantageous in that it provides lower air resistance between the channels and the inter-belt gaps and also enables the belts to ride back on to the top of the bumps if they move laterally away from their correct position.

In a further modification the vacuum apertures need not be provided at both ends of each channel 54. For example, vacuum apertures 52 may be provided only in alternate channels, and/or only at one end thereof, or any other configuration as may be appropriate. Indeed, when the transport belts are opaque, as described above, the vacuum apertures will not be exposed even if they are located in the imaging area of the platen since they will be concealed by the overlying belts.

Finally, it is noted that although the embodiment described above employs unapertured belts (in which case show-through and show-around are minimised), the invention may also be used with apertured belts when it is desired to extend the effect of the partial vacuum to the area of the belts themselves.

I claim:

1. A document feeder for conveying document sheets into and away from an imaging position on a platen of a copier, including a vacuum belt transport system which comprises:

a plurality of spaced-apart and unapertured belts moving between a white backing surface member and the platen, and a vacuum source for applying a partial vacuum to the inter-belt gap areas from beneath the belts to hold a document sheet against said belts so that the document is conveyed with the movement of the belts, characterized in that;

said backing surface member is entirely planar in at least said inter-belt gap areas in said imaging position, multiple spaced protrusions which extend out from the backing surface member toward the platen are provided extending above the level of said plane of said backing surface member in said inter-belt gap areas at intervals on said backing member, beneath the belts, against which protrusions the belts ride to hold the belts spaced away from said backing surface member, the interstices between said protrusions providing openings to said inter-belt gaps from beneath the belts for said applying of partial vacuum to said inter-belt gaps, and wherein said protrusions are provided in mutually parallel rows extending in the direction of movement of the belts, with each belt riding on a respective pair of such rows of protrusions.

2. A document feeder as claimed in claim 1, wherein said rows of protrusions are adjacent the edges of the belts.

3. A document feeder as claimed in claim 1, wherein channels are provided in the backing surface extending parallel to the belts, and wherein each belt overlies a respective said channel.

4. A document feeder as claimed in claim 1, wherein, in the direction of said belt movement, the dimension of said protrusions is greater than the dimension of said interstices between said protrusions.

* * * * *